US006454525B2

(12) United States Patent
Blecker et al.

(10) Patent No.: US 6,454,525 B2
(45) Date of Patent: Sep. 24, 2002

(54) TURBOMOLECULAR PUMP

(75) Inventors: Armin Blecker, Asslar (DE); Wolfgang Bremer, Biebertal (DE); Peter Fahrenbach, Braunfels (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/792,442

(22) Filed: Feb. 23, 2001

(30) Foreign Application Priority Data

Mar. 2, 2000 (DE) ..... 100 10 371

(51) Int. Cl.[7] ..... F03B 5/00
(52) U.S. Cl. ..... 415/90; 415/213.1
(58) Field of Search ..... 415/90, 213.1, 415/220; 417/423.4

(56) References Cited

U.S. PATENT DOCUMENTS 760,776 A * 5/1904 Campbell ..... 415/106
3,477,381 A * 11/1969 Becker ..... 415/182.1
3,749,528 A * 7/1973 Rousseau et al. ..... 310/90.5
4,036,565 A * 7/1977 Becker ..... 310/67 R
5,052,887 A * 10/1991 Novikov et al. ..... 415/90

FOREIGN PATENT DOCUMENTS

JP 404017798 A * 1/1992 ..... 417/423.4

* cited by examiner

*Primary Examiner*—Edward K. Look
*Assistant Examiner*—Igor Kershteyn
(74) *Attorney, Agent, or Firm*—Sidley Austin Brown & Wood, LLP

(57) ABSTRACT

A turbomolecular pump including a plurality of rotor and stator discs alternatingly arranged with each other, a plurality of spacer rings for spacing the stator discs from each other, and at least one elastically deformable metallic member arranged between at least two spacer rings, with the stator discs, the spacer rings, and the elastically deformable metallic member forming together a stator stack.

4 Claims, 2 Drawing Sheets

TURBOMOLECULAR PUMP

BACKGROUND OF THE INVENTION

1. Field of the Invention

The present invention relates to a turbomolecular pump including a plurality of alternatingly arranged rotor and stator discs, and a plurality of spacer rings for spacing the stator discs from each other, with the stator discs and the spacer rings forming a stator stack.

2. Description of the Prior Art

Active pump elements of a turbomolecular pump consist of rotor and stator discs which are provided with vanes and which are alternatingly arranged one behind the other. Generally, each of the stator and rotor discs has a support disc which supports an outer member provided with vanes. The vanes of the rotor discs, which rotate with high speed, together with the stator vanes, provide a pumping effect. The stator discs are spaced from each other by spacer rings which are provided between the stator discs at the outer circumferences of the stator discs. The spacing between the stator discs insure a contact-free rotation of the rotor discs between the stator discs. The stator discs and the spacer rings form a stator package or a stator stack which is centered by the inner wall of the pump housing. The stator package or stack can include, e.g., springs for axially biasing the stator discs and spacer rings toward each other so that a rigid connection is formed therebetween.

To provide for a precise assembly of stator discs, spacer rings, and other elements of the stator stack, repeated adjustments need be made in order to compensate the manufacturing tolerances. This noticeably increases the time connected with manufacturing of the stator components and with the assembly of the stator.

By providing an O-ring, e.g., formed of Viton®, between the spacer ring adjacent to the forevacuum side and the lower part of the pump, a partial compensation of the manufacturing tolerances can be achieved.

One of the drawback of the above-discussed compensation of the manufacturing tolerances consists in a very bad heat conductivity of the O-ring material. As a result, during the operation of the pump, the heat, which is generated inside the pump, is only partially transmitted to the pump housing and the lower part of the pump. In addition, during pumping of aggressive media, the insufficient corrosion resistance of the O-ring material presents a problem. In addition, because of the high degasifying rate, this O-ring cannot be used on the high vacuum side.

French Patent No. 2,683,277 discloses means for simplifying the assembly and maintenance of this type of pumps. According to the French patent, the intermediate, adjacent to the high vacuum side, ring is provided with a sharp, knife-shaped edge, which becomes deformed during the formation of the stator stack, compensating, thus, the manufacturing tolerances. In this case, the material of the stator elements and the spacer ring should be the same.

An object of the present invention is to provide, in a turbomolecular pump, means which would permit to compensate manufacturing tolerances of separate components of the stator stack and which would be devoid of drawbacks of the prior art means.

Another object of the present invention is to provide, in a turbomolecular pump, manufacturing tolerances compensating means which would afford a greater freedom in the selection of their material and would insure a better heat conductivity.

SUMMARY OF THE INVENTION

These and other objects of the present invention, which will become apparent hereinafter, are achieved by providing at least one elastically deformable metallic element between at least two spacer rings and which also forms part of the stator stack.

The elastically deformable metallic element or member compensates, during assembly of the stator, the manufacturing tolerances. The elastically deformable metallic member insures precise spacing between the rotor and stator components. The use of the elastically deformable metallic member permits to eliminate the time-consuming adjustments taking place during assembly of a conventional pump. The elastically deformable metallic member can be used in any region of the pump, including the high vacuum side of the pump. By selecting a suitable metallic material for forming the elastically deformable member, it can be made insensitive to aggressive media. By the metallic contact of the elastically deformable member with other components, heat removal can be favorably influenced. Moreover, by providing an elastically deformable member having different shapes and formed of different materials, it is possible to vary the heat conductance.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
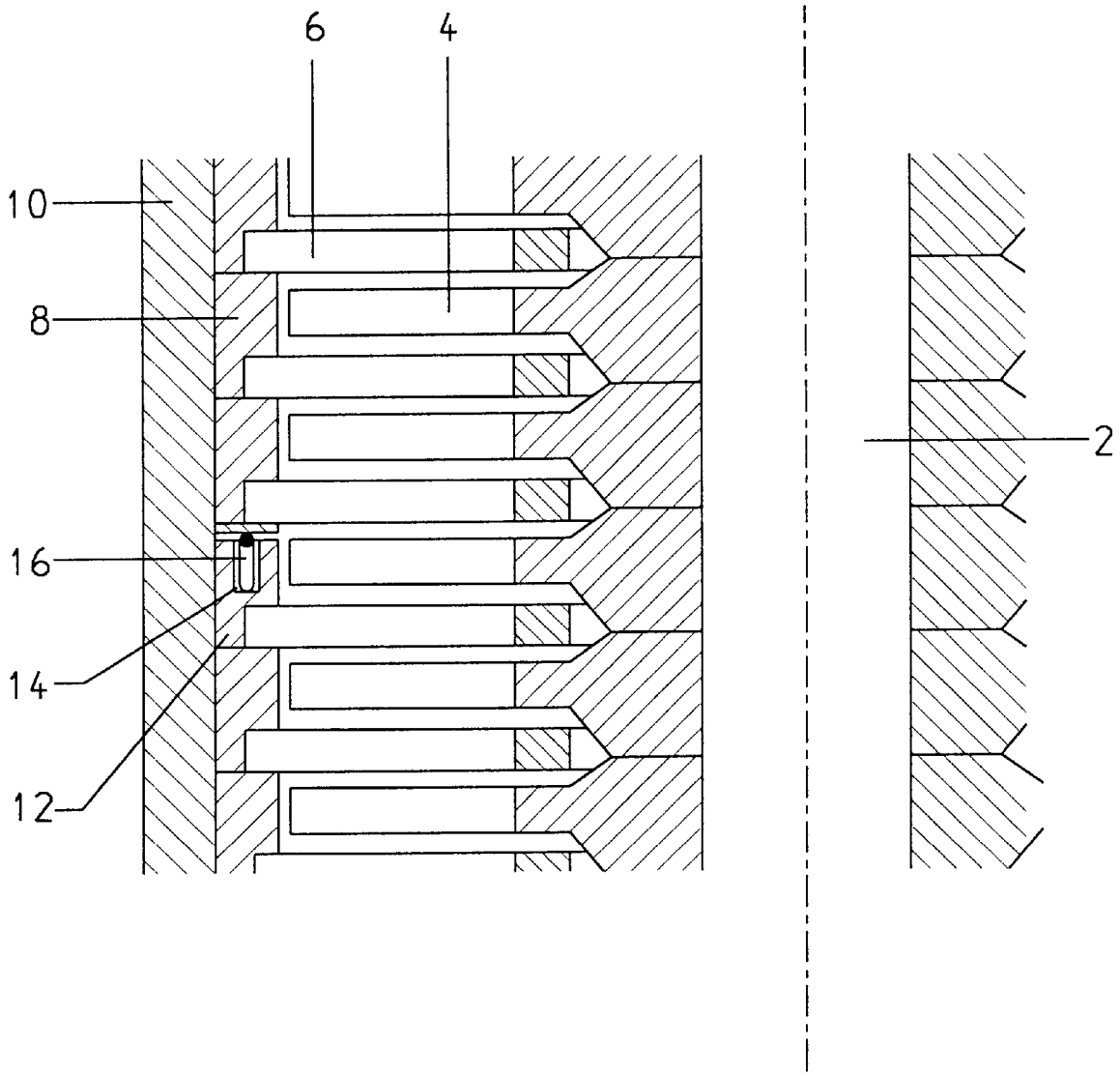
FIG. 1 a cross-sectional view of a portion of a turbomolecular pump according to the present invention.
Figure 2:
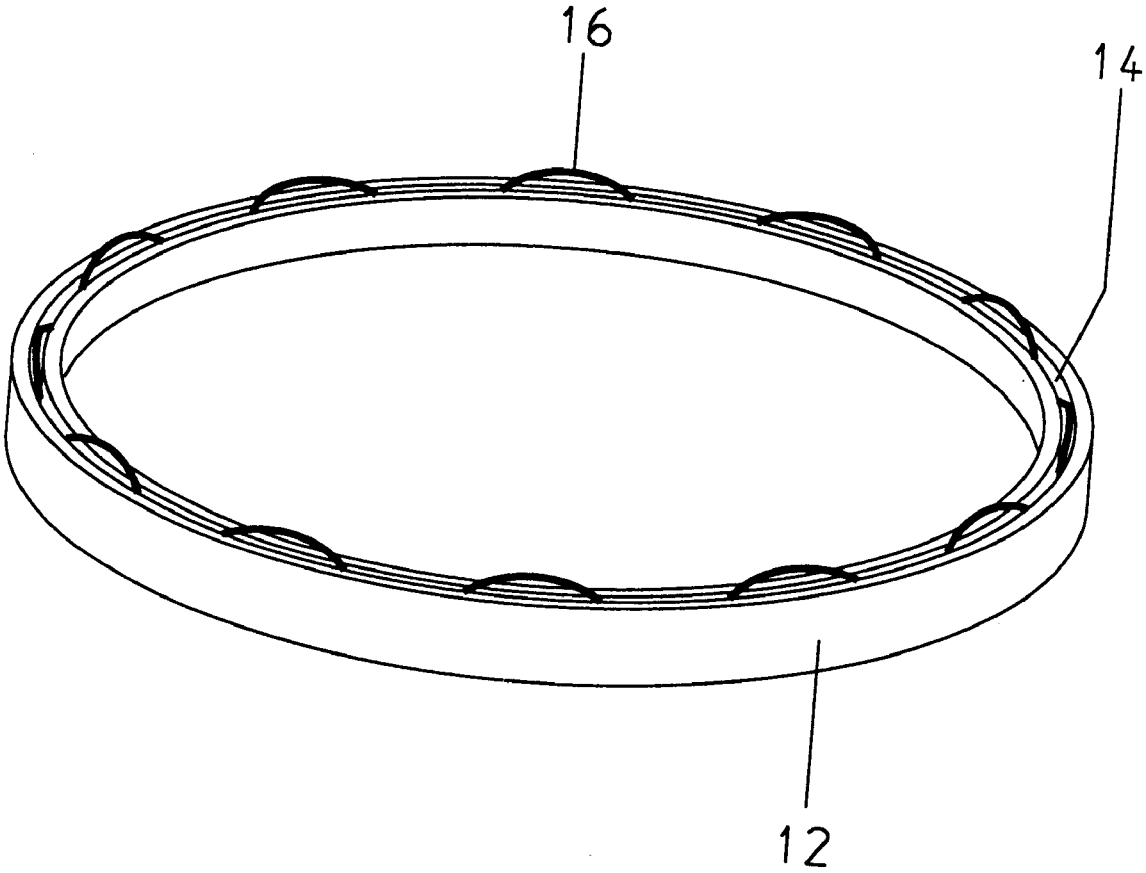
FIG. 2 a perspective view of a spacer ring according to the present invention.

A turbomolecular pump, which is shown in FIG. 1, includes a housing 10 in which the pump rotor and stator are arranged. The pump rotor is formed of a plurality of rotor discs 4 supported on the rotor shaft 2. The stator is formed of a plurality of stator discs 6 which are spaced from each other by spacer rings 8 and which are arranged between the rotor discs 4. The rotor and stator discs 4 and 6 have a gas delivering structure and together provide for the pumping function of the pump. The stator discs 6 and the spacer rings 8 form together a stator stack which is centered by the inner wall of the pump housing 10. At least between two spacer rings 8, there is provided an elastically deformable metallic member 16. The elastically deformable metallic member 16 forms part of the stator stack. At least one of the spacer ring 8 is provided with a groove 14 which is formed in a ring member 12 forming the spacer ring 8. The elastically deformable member 16 is located in the grooves 14. The elastically deformable member 16 can be formed as a one-piece member or be formed of several separate sections. In accordance with one of its embodiments, the elastically deformable member 16 can be formed of an undulated wire. During assembly of the pump, in particular during the formation of the stator stack, the manufacturing tolerances are compensated as a result of the deformation of the elastically deformable member 16.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A turbomolecular pump, comprising a plurality of rotor discs and a plurality of stator discs, with separate rotor and stator discs being alternatingly arranged; a plurality of spacer rings for spacing the stator discs from each other; and at least one elastically deformable metallic member arranged between at least two spacer rings, wherein the stator discs, the spacer rings, and the elastically deformable metallic member form together a stator stack, wherein at least one of the at least two spacer rings has an axially extending groove for receiving the at least one elastically deformable metallic member.

2. A turbomolecular pump as set forth in claim 1, wherein the elastically deformable metallic member is formed of several sections;

a turbomolecular pump, comprising a plurality of rotor discs and a plurality of stator discs, with separate rotor and stator discs being alternatingly arranged; a plurality of spacer rings for spacing the stator discs from each other;

and at least one elastically deformable metallic member arranged between at least two spacer rings, wherein the stator discs, the spacer rings, and the elastically deformable metallic member form together a stator stack, wherein at least one of the at least two spacer rings has an axially extending groove for receiving the at least one elastically deformable metallic member.

3. A turbomolecular pump, comprising a plurality of rotor discs and a plurality of stator discs, with separate rotor and stator discs being alternatingly arranged; a plurality of spacer rings for spacing the stator discs from each other;

and at least one elastically deformable metallic member arranged between at least two spacer rings, wherein the stator discs, the spacer rings, and the elastically deformable metallic member form together a stator stack, wherein the elastically deformable metallic member is formed of an undulated wire.

4. A turbomolecular pump as set forth in claim 3, wherein the elastically deformable metallic member is formed of several sections.

* * * * *